United States Patent [19]

Grüber et al.

[11] Patent Number: 4,463,467

[45] Date of Patent: Aug. 7, 1984

[54] METHOD AND APPARATUS FOR APPLYING A PATTERN TO A CONTINUOUSLY ADVANCING WEB OF MATERIAL

[75] Inventors: Heinz Grüber, Tönisvorst; Johannes Kutz; Manfred Moser, both of Krefeld, all of Fed. Rep. of Germany

[73] Assignee: Eduard Küsters, Krefeld, Fed. Rep. of Germany

[21] Appl. No.: 389,892

[22] Filed: Jun. 18, 1982

[30] Foreign Application Priority Data

Aug. 18, 1981 [DE] Fed. Rep. of Germany ..... 3132565
Sep. 1, 1981 [DE] Fed. Rep. of Germany ..... 3134569

[51] Int. Cl.[3] ..... D06B 1/06

[52] U.S. Cl. ..... 8/151; 68/204; 68/205 R; 118/325; 427/244; 427/277; 427/286; 427/288

[58] Field of Search ..... 156/78, 244; 427/420, 427/286, 244, 277, 288; 68/205 R, 204; 8/477, 151; 118/325

[56] References Cited

U.S. PATENT DOCUMENTS 3,964,860 6/1976 Leifeld ..... 118/325 X

*Primary Examiner*—Evan K. Lawrence
*Attorney, Agent, or Firm*—Kenyon & Kenyon

[57] ABSTRACT

A method and apparatus for applying a pattern to a continuously advancing web with a foam containing treatment medium. The pattern may be generated in the foam prior to or after the foam is transferred to the web. In one embodiment, the pattern is generated using two foam feeding devices arranged to form a patterned layer on a revolving element positioned over the web. The forward velocity of the web and the speed of rotation of the revolving element are controlled to obtain the desired pattern effect on the web.

9 Claims, 19 Drawing Figures

METHOD AND APPARATUS FOR APPLYING A PATTERN TO A CONTINUOUSLY ADVANCING WEB OF MATERIAL

BACKGROUND OF THE INVENTION

This invention relates to the application of patterns to a continuously advancing web of material in general and more particularly to an improved method and apparatus for carrying out such an application using foam.

DE-AS No. 22 14 377 teaches methods of the general type to which the present invention relates. The pattern obtained depends on the treatment agents present in the layer. Also, different foams may be present in the layer on top of each other or side by side. A pattern can be obtained by selectively wiping the layer to a different height in some places than in adjacent places. Treatment, however, always occurs because of the presence of the layer, i.e. a supply of treatment medium in a rather uniform amount, as seen over the area.

It is an object of the present invention to develop a method of the general type described above and a corresponding apparatus in such a manner that a novel and far-reaching modification of the resulting pattern is possible.

SUMMARY OF THE INVENTION

According to the present invention, this problem is solved by making the foam uneven in the layer in places or traces. In the preferred embodiments of the invention, the pattern is a color pattern, in which one or more dyeing liquors are contained in the foam. Besides the dyeing liquors, however, also resists, agents which influence the field and the structure of the web of material, and the like, which are applied in the form of foam, are of interest as treatment agents.

The web of material may be a textile web material but also a bonded woven fabric, a paper web, a web of plastic or the like.

The invention includes basically two embodiments. In the first embodiment, the unevenness is made in a layer in which the foam is made available even before it is transferred to the web.

In the second embodiment, the unevenness is accomplished as soon as the foam has been transferred to the web. Depending on the composition and the properties of the foam and depending on the structure of the web, the foam will still lie on the surface of the web for a certain amount of time as a layer without penetrating into it substantially. In this phase, operation on the foam has been drawn or worked into the web, the formation of the pattern in the web begins practically immediately, for instance in the case of dyeing, the absorption, and substantial influence on the pattern is no longer possible.

This unevenness should be made in places or traces. In effect this can be described as "writing in foam." Places or traces are to be point-like or line-like zones of dimensions substantially smaller than the width of the web of material. With a width of the web of 2 to 5 m., these zones should have a diameter or width down to the width of a finger or pencil. However, somewhat larger dimensions also fall under the present invention, i.e. all dimensions such as are used for obtaining patterns on the customary substrates such as textile goods for apparel and decoration and for rugs.

The unevenness obtained in the foam layer in places or traces is transferred to the web of material and manifests itself in its pattern. This is a circumstance which is favored by the fact that the foam has a very much smaller or practically no mobility as compared to a liquid, depending, of course, on its foam number, i.e. the volume ratio between the liquid forming the foam and the foam. The higher the foam is blown up, the smaller is its mobility and the more faithfully are the patterns which have been generated on the "surface" on the web maintained. A liquid would penetrate into the web of material immediately, in any event in the case of textile goods, and there would be no opportunity at all to apply a pattern comparable to the present invention.

The patterns attainable by the present invention with the application of foam are distinguished by a substantially greater conciseness than with pattern application of liquid which is known from DE-OS No. 23 61 517.

The unevenness can be achieved by displacement of the foam. Here, the displaced amount of foam accumulates in the edges of the displacement region and leads there to an increased supply of treatment medium, which manifests itself, for instance, in dyeing by the fact that the color appears particularly deep at the edge of the displacement region and therefore accentuates the latter. This effect is lacking if the foam is instead removed.

Conversely, something can also be added namely, a gaseous, liquid or solid treatment medium which either treats the foam, for instance makes it collapse around it locally as is basically known from DE-AS No. 22 14 377, or to obtain a treatment effect on the web of material in addition to the treatment effects obtained by the foam and its components.

The apparatus for implementing the method of the present invention comprises a foam generating device and a foam application device, by means of which the foam can be applied to the web of material in the form of a layer, as well as a device for making a pattern on the layer.

The apparatus according to the present invention comprises at least one motion generator arranged above the web of material as well as an attack element connected thereto for making the foam layer uneven in places or traces.

The attack element modifies the foam layer and applies therein the unevenness in places or traces. In the process, the attack element is moved by a motion generator in order to generate a pattern in the foam layer passing by the attack element. It is also within the scope of the present invention for the motion generator to generate no motion, i.e. hold the attack elements still so that a stripe-like pattern is obtained in the foam layer. Normally, however, the attack elements will also contain crosswise motion components so that a two-dimensional pattern is brought about in the foam layer.

The attack elements can develop their effect down to the bottom of the foam layer, but the pattern according to the present invention is also obtained even if the foam layer is made uneven only over part of its height in places or traces.

The motion generators can be common to several attack elements. However, a separate motion generator can also be assigned to each attack element.

While, therefore, in the first-mentioned case a number of attack elements attached to a common support, if designed in the same manner, execute the same motion and therefore generate a pattern with a sort of rapport, the second embodiment provides a possibility for generating an entirely random pattern, in that all motion generators provided transmit motions to their associated attack elements independently of each other.

An important embodiment of the present invention is one in which the use of the attack elements is separately controlled. Due to the fact that at least one of the attack elements can be turned off or, in the case of a mechanical attack element can be lifted off the surface, it can be put out of operation as desired, whereby a further modification can be given to the pattern.

Various types of attack elements are described. A rod or strip-like member acts like a kind of pencil or finger which extends entirely or partially into the foam layer on the web. Such an attack element can be rigid or flexible. In particular, a flexible element may touch the web and rub on the web.

A preferred embodiment of the attack element is a drawing element. The drawing element can be a more or less thick rope or a chain or the like which executes, due to its mobility relative to the motion generator, independent motions which are reflected in corresponding tracks in the foam layer. It falls within the scope of the present invention for the drawing member itself, for instance, if a chain is involved, to act upon the foam layer. However, an additional pendulum body which moves in the foam layer can also be attached at the free end. In one embodiment, the pendulum body rolls or slides back and forth on the web of material.

If it is a sphere, the generated pattern track is relatively narrow with slowly changing edges.

With a pendulum body having at least one flat surface, the track is wider and is cleared completely of foam since the pendulum body rests flat on its plane surface.

The above-mentioned elements displace the foam to the side. The attack element, however, may also be a suction trunk in communication with a suction line, which draws the foam from the foam layer in places or traces.

Instead of removing the foam in places or traces, something can also be added in such zones. This can be accomplished with a spraying device by means of which a narrowly bounded jet of a gaseous liquid or powder-shaped treatment medium can be directed toward the foam. It is not the subject of the present invention to spray the entire foam surface uniformly. Essential is rather the narrow limitation of the jet whereby the "writing in foam" is possible.

The attack element may also be a light source, by means of which a narrowly defined light or infrared beam can be directed onto the foam. Due to the temperature rise occurring in the incidence region of the beam in the foam, the foam is there decomposed or can also be changed otherwise, so that a pattern can also be obtained in this manner.

DETAILED DESCRIPTION

Figure 1:
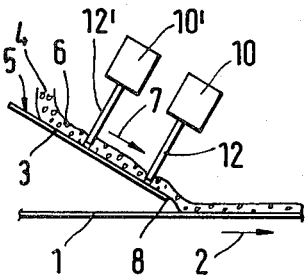
FIGS. 1 to 3 are side views, transverse to the web, of three basic embodiments of devices according to the present invention, in which the unevenness of the foam layer is accomplished before it is applied onto the web.

In FIG. 1, a web of material 1 is shown which is moved forward in the direction of the arrow 2 on a substantially horizontal guide via rolls or the like, not shown. Across the width of the web of material, a running-off surface 3 in the form of an elongated rectangular plate with a closed plane surface is provided, on which foam in the form of a layer can be placed in the upper region at 4 by a foam applicator, not shown. The surface of the plate 3 forms the "area" 5 on which the foam in the form of the layer 6 slides down over the plate 3, in the direction of the arrow 7 under the action of gravity, and is transferred from the lower edge 8 of the plate to the web 1.

Above the plate 3, a motion generator 10 is arranged which is merely indicated by a rectangle and from which an attack element 12 in the form of a rod protrudes toward the plate 3. The rod extends almost to the plate 3 but can also end a predetermined amount above it, but in any case engages the foam layer 6 and displaces the foam and makes it uneven at this point. The motion generator 10 imparts to the attack element 12 motions which extend perpendicular to the plane of the drawing, i.e. transversely to the web 1 and direction of motion 7 of the foam layer 6, but may in addition also have a component parallel to the direction 7.

As will be further explained in connection with FIGS. 5 and 6, several motion generators 10, each with an associated attack element 12 may be provided side by side transversely to the web 1, or several attack elements 12 arranged side by side may be mounted on one motion generator 10.

FIG. 1 shows, in addition, that the arrangement of the motion generators and attack elements can also be staggered in the direction 7 of the foam movement, as is indicated by the second motion generator 10' with the attack element 12'.

Figure 2:
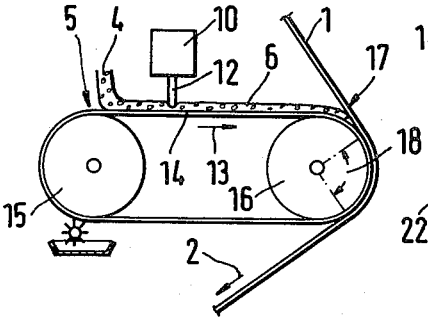

In the embodiment of FIG. 2, the "area" 5 is formed by the upper section, advancing approximately horizontally in the direction of the arrow 13, of a belt 14 which is guided endlessly about two drums 15 and 16 and on which the foam is placed at 4 in the form of a layer 6, and with which the web of material 1 is brought together at point 17, a point following the attack point of the attack element 12. The web of material 1 is looped over the drum 16 in the manner shown in FIG. 2, by a certain looping angle 18 which is approximately 90° in the illustrated embodiment, and accepts in the process the patterned foam which is enclosed between the web of material 1 and the surface of the belt 14.

Figure 3:
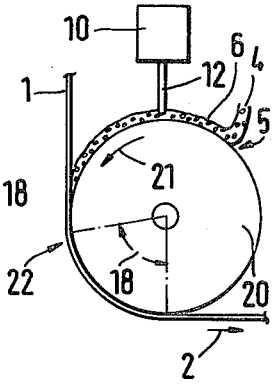

In the embodiment of FIG. 3, the "area" 5 is formed by the surface of a drum 20, which revolves in the direction of the arrow 21. After passing the attack element 12 and the pattern-making taking place there, the foam layer 6 applied at 4 is enclosed between the surface of the web 1 which is running onto the circumference of the drum 20 approximately at 22 and is accepted by the web 1 during the passage through the looping angle 18 which is again about 90° in the example.

Figure 4:
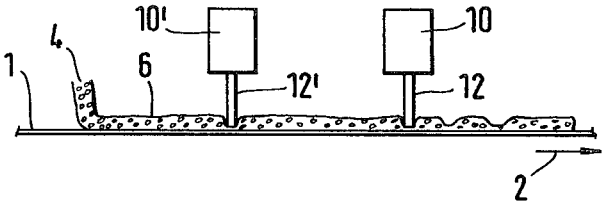
FIG. 4 is a corresponding view of an embodiment in which the unevenness of the foam layer is accomplished after it is applied to the web.

In FIG. 4, a web of material 1 is shown which moves forward on a substantially horizontal guide via rolls or the like, not shown, in the direction of the arrow 2. At 4, foam in the form of a layer is placed across the width of the web of material by a foam applicator, not shown.

Above the web of material 3, a motion generator 10 is arranged which is merely indicated by a rectangle and engages the foam layer 6 in the same manner as is the case in FIGS. 1 to 3, and displaces the foam and makes it uneven at the point in question. Similarly, several motion generators 10 with associated attack elements 12 can be provided side by side transversely to the web 1 also in this embodiment, or several attack elements 12, arranged side by side, can be mounted on one motion generator 10, and the arrangement of the motion generators and attack elements can also be staggered in the direction 2 of the web motion, as is indicated by the second motion generator 10' with the attack element 12'.

Figure 5:
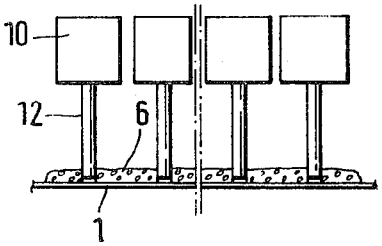
FIGS. 5 and 6 are views in the longitudinal direction of the web of different embodiments of the present invention.
Figure 11:
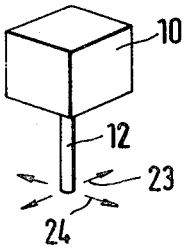
FIG. 11 is a perspective view of a motion generator with an element which is movable to all sides.

In FIG. 5, the web of material 1 runs perpendicularly to the plane of the drawing. Several motion generators 10, each with an associated attack element 12, are arranged side by side. Since a separate attack element is associated with each motion generator, all attack elements 12 can execute motions different from each other. For example, each may be controlled by a random motion generator. The motion is executed as indicated in FIG. 11 in the direction of arrow 23 transverse to the web of material as well as also, in the direction of arrow 24 in the longitudinal direction of the web of material, so that any desired pattern can be brought about in the plane of the web of material 1 through the superposition of the two motions.

Figure 6:
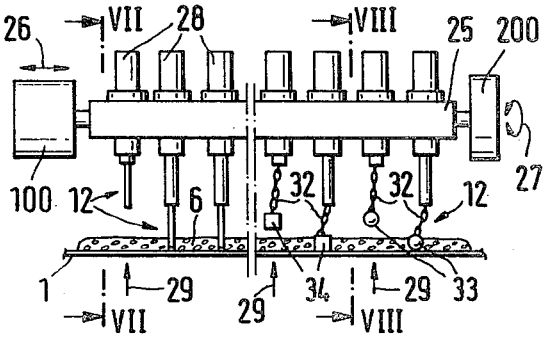

In FIG. 6, a beam 25 in the form of a square hollow section is provided across the width of the web of material 1, at the ends of which a motion generator 100 is attached for generating a motion of the beam going back and forth in the direction of the arrow 26 transverse to the web of material 1, and on the other side, a motion generator 200, which causes a reciprocating rotary motion of the beam 25 in the direction of the arrow 27. The most varied patterns are produced by the controlled superposition of the two motions. In addition, a further pattern possibility is created here in that the individual attack elements 12 are attached to pneumatic piston/cylinder units 28 which permit lifting the attack elements off the foam layer 6 so that they generate a pattern or not as desired. At the points marked by the arrow 29, the attack elements 12 are not in engagement. The pneumatic piston/cylinder units 28 are coupled to a common pneumatic feed line and can be actuated by electrically controlled valves as desired. Instead of the pneumatic piston/cylinder units 28, corresponding magnetic actuators can, of course, also be provided.

Figure 7:
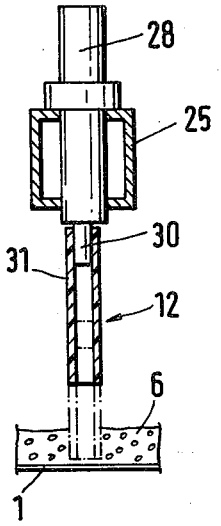
FIG. 7 is a cross section along the line VII—VII in FIG. 6.

In the cross sectional view of FIG. 7, the attack elements 12 provided in the left half of FIG. 6 are shown in detail. These are tube or hose sections 31 which are mounted on the piston rod 30 of the piston/cylinder unit 28 and which are, if the piston rod 30 is pulled in, located with their lower end, in the manner seen in FIG. 7, at a distance above the foam layer 6. The lower ends dip into the foam layer 6 if the piston rod is extended, and displace the foam at this point. The tube or hose section 31 is shown as open at the bottom but it may, of course, also be closed. Likewise it is possible to attach to the lower end still larger displacement or wiper bodies which enlarge the action range of the attack element 12 and produce wider places or traces at which the foam has been displaced.

Figure 8:
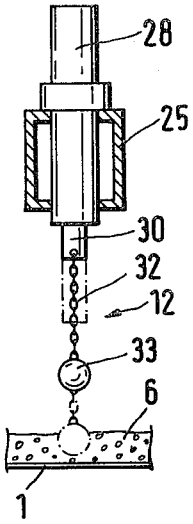
FIG. 8 is a cross section along the line VIII—VIII in FIG. 6.

FIG. 8 shows another embodiment of the attack element 12 in which, instead of the relatively stiff tube or hose section 31, a completely flexible chain 32 is fastened to the piston rod 30; in the illustrated embodiment this chain has a sphere 33 at the other end which, with the piston rod 30 pulled in, is suspended above the foam layer 6 but extends, with the piston rod 30 pulled out, into the foam layer 6 in the manner shown and makes the latter uneven. The difference from the embodiment according to FIG. 7 is that there, the track of the attack element is uniform over a certain width, while the sphere produces a trace with the lowest point and uniform rise toward the edges in the foam layer 6. The embodiment according to FIG. 8 can also be developed so that the balls 33 rest on the web of material 1; then, the sphere 33 can roll back and forth on the surface of the web of material 1. Instead of a sphere, a pendulum body 34, bounded by flat surfaces, in the form of a cube or the like which generates tracks corresponding to the embodiment according to FIG. 7 may also be used.

If the foam layer 6 contains different, especially differently colored, foams on top of each other or side by side, an additional pattern effect is obtained in that the attack elements 12 drag foam from one region into an adjacent region, so that traces of the first foam are found in the latter, and cooperate in forming the pattern.

Figure 9:
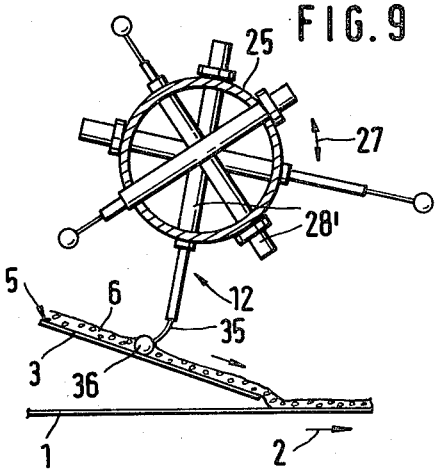
FIGS. 9 and 10 are a cross section through the support designed as a revolving tube with elongated elements.

In FIG. 9, a further possible embodiment is shown, in which the beam 25 is designed as a tube which extends across the web 1 and is driven, similarly as in FIG. 6, by motion generators 100 and 200, and in which piston/cylinder units 28' are arranged which carry at the end of their piston rod, via a resilient connecting piece 35, wiper or displacement bodies 36 which engage the foam layer 6 upon rotation, sliding in the process, on the surface 5, bending the connecting members 35, and displacing the foam. The piston/cylinder units 28' may be distributed over the circumference of the carrier 25 if the carrier is revolved continuously in one direction; if the carrier 25 executes a back and forth movement, the piston/cylinder units would be arranged predominantly in an angular range facing the foam layer.

Figure 10:
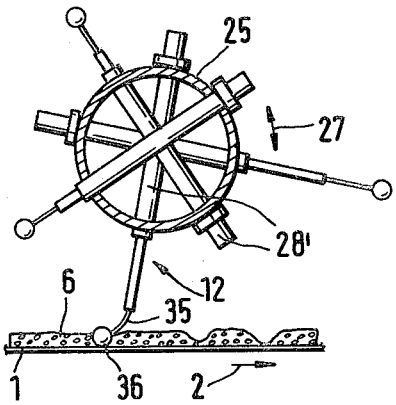

In FIG. 10, a corresponding embodiment is shown which is used for making a foam layer 6 which is already on the web 1, uneven.

Figure 12:
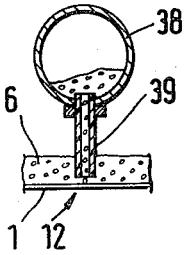
FIG. 12 is a cross section through an arrangement with suction trunks.

In FIG. 12, an embodiment in which a suction tube extending crosswise to the foam layer is provided with suction trunks 39 distributed over the width of the web of material 1 is shown. Suction trunks 39 extend into the foam layer 6 and draw off the foam in places or traces. There, the foam is therefore not displaced into the adjoining regions as in the previous embodiments but is actually removed from the foam layer 6. Attack elements in the form of suction trunks 39 can, of course, also be provided with individual motion generators 10 as in FIGS. 1 to 4.

Figure 13:
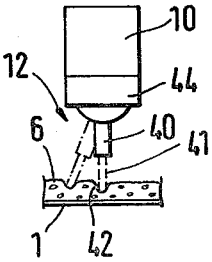
FIG. 13 is a view of a motion generator with a spraying device arranged thereon.

In the embodiment according to FIG. 13, a spraying device 44 is connected to a motion generator 10; this device comprises a spraying nozzle 40 from which a largely parallel, collimated jet 41 of a gaseous, liquid or powder-shaped treatment medium can be aimed toward the foam layer 6. The treatment medium can make the foam collapse in traces as indicated at 42, or cause treatment effects in places or traces which act, in addition to the effect of the foam layer 6, on the web of material 1. In the illustrated embodiment, the motion generator 10 is stationary and the direction of the jet of the nozzle 40 can be controlled or swung randomly in all directions in the same manner as is indicated in FIG. 11.

Figure 14:
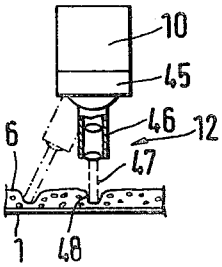
FIG. 14 is a view of a motion generator with a light source with collimator arranged thereon.

In the embodiment of FIG. 14, a light source 44 is connected to the motion generator 10 and comprises a collimater 46 which directs a parallel light beam 47 toward the foam layer 6 which breaks down locally by the heating effect as indicated by 48. Instead of the light source 45 with collimator 46, a laser arrangement can also be provided which brings about higher energy density. Also in the embodiment according to FIG. 4, the direction of the jet 47 can be changed by the motion generator 10 in the sense of FIG. 11.

In the last-mentioned embodiments, the nozzle 40 with the jet 41 and the collimator 46 with the light beam 47, respectively, form the attack element 12.

Figure 15:
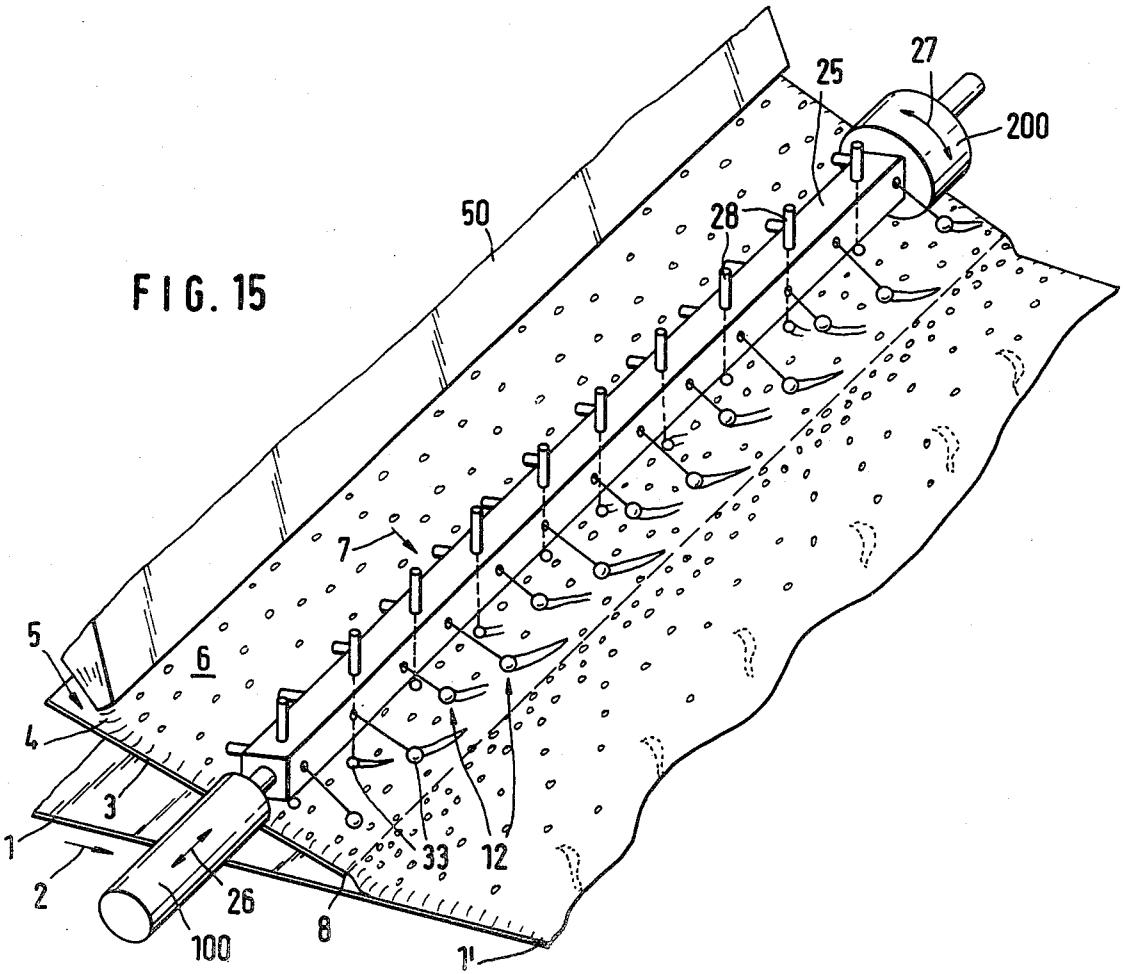
FIGS. 15 and 16 are perspective views of practical embodiments of the invention with a support extending crosswise over the web and elements.

In FIG. 15, a further embodiment of the present invention is shown in perspective view. This embodiment comprises a beam 25 extending across the web according to FIG. 6 and attack elements according to FIG. 8. The balls 33 slide on the inclined runoff plate 3 in line with the crosswise motion generated by the motion generator 100 according to the arrow 26 and back and forth with the superimposed back and forth rotary motion of the motion generator 200 according to the arrow 27 and are subjected to additional displacements by the piston/cylinder units 28. In the case of the substantially vertical piston/cylinder units 28, the balls 33 can be pulled entirely out of the foam layer 6 as is shown in FIGS. 6 and 8, while the substantially horizontal piston/cylinder units 28 pull up the balls 33 fastened thereto closer to the beam 25 or continue to leave them away therefrom.

In the embodiment of FIG. 15, the foam layer 6 is generated by a wide slit nozzle 50 which extends over the entire width of the web 1 and the area 5. The foam layer 6 generated can be further equalized in its motion in the direction of the arrow 7 over the area 5 by wiper arrangements, not shown, before the attack elements 12 formed by the balls exert their pattern forming effect. The foam layer goes from the lower edge 8 of the plate 3 to the web of material 1 which travels underneath in the direction of the arrow 2 and is accepted immediately by the latter. This is indicated by the frequency of the foam bubbles, which decreases toward the right hand edge 1' of the web of material 1. The distance to the complete collapse of the foam and its complete absorption by the web can relatively, of course, also be substantially longer than is shown in FIG. 15.

Figure 16:
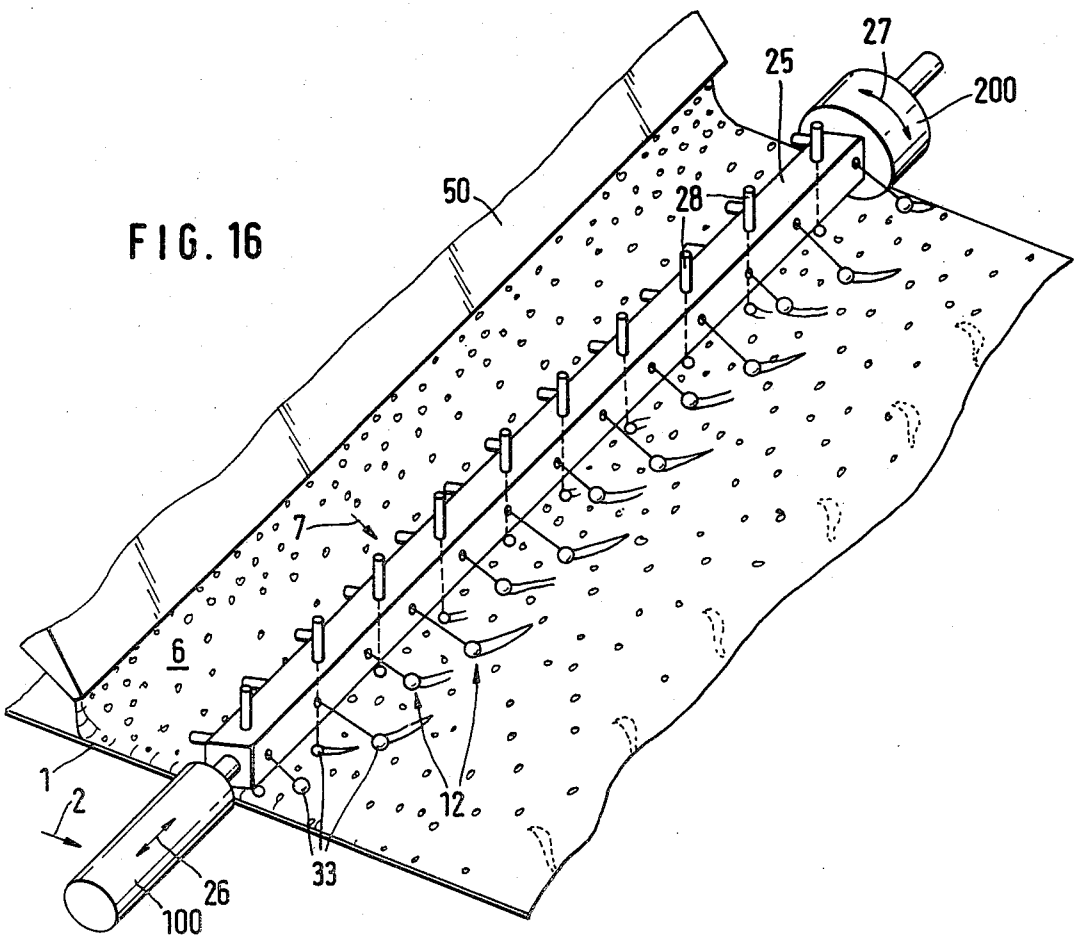

In FIG. 16, a further embodiment of the present invention is shown in perspective view in which the foam layer 6 is generated by a wide slit nozzle 50 on the web 1 and the attack elements act in the foam already present on the web 1.

Figure 17:
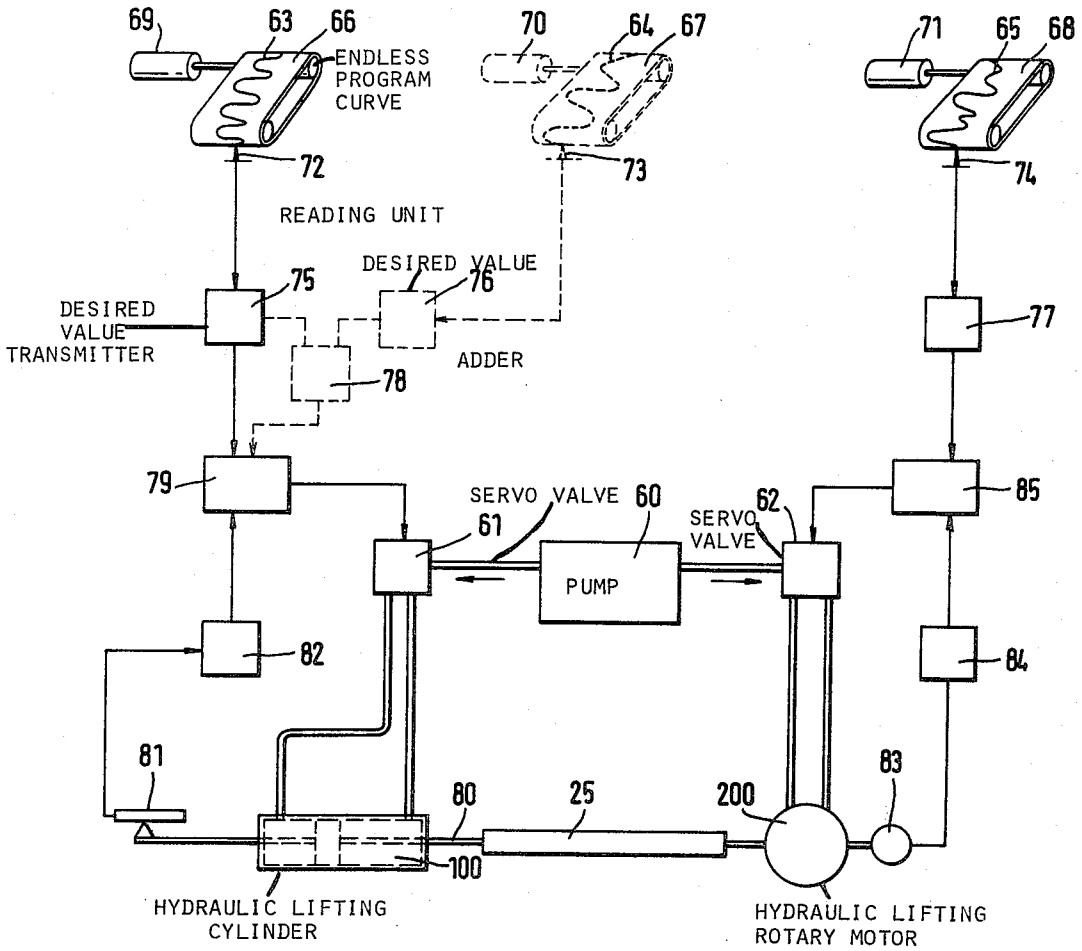
FIG. 17 is a control for an arrangement according to FIGS. 15 and 16.

In FIG. 17, a control for an arrangement according to FIGS. 15 or 16 which permits producing repetitive patterns is illustrated.

A hydraulic pump 60 supplies, via servo valves 61 and 62 respectively, pressurized liquid to the motion generator 100 which is designed as a hydraulic lifting cylinder, or to the motion generator 200 which is designed as a hyraulic rotary motor. The servo valves 61 and 62 are controlled by programs on endless program curves 63, 64 and 65 on endless belts 66, 67 and 68. The endless belts 66, 67 and 68 are driven by motors 69, 70 and 71 with a predeterminable speed. The program curves 63, 64 and 65 are scanned by reading units 72, 73 and 74 which are shown only schematically and deliver a voltage or current corresponding to the excursion, which appears amplified and as an electric set-value quantity at the output of the desired value transmitter 75, 76 and 77. For the motion generator 100, two program curves 63 and 64 are provided in the example, which are superimposed in an adding unit 78 and processed into a resulting desired value. The desired value at the output of the desired value transmitter 75 and the adding unit 78, respectively, is fed to a desired actual value comparator 79, into which an electric signal representing the piston position in the motion generator 100, designed as a piston/cylinder unit. Another signal, which is obtained by transmitting the motion of the piston rod 80 to a linear potentiometer 81 and converting the potentiometer output in an actual value transmitter 82 into a suitable input variable for the desired actual value comparator 79 is also fed to comparator 79. The servo valve 61 is therefore controlled in accordance with the difference between the desired value corresponding to the instantaneous excursion value of the program curve 63 and the actual position.

Correspondingly, the motion generator 200 is connected to a rotary potentiometer 83, the output signal of which is processed in an actual value transmitter 84 and is fed, together with the output signal of the desired-value transmitter 77, into a desired actual value comparator 85 which then controls the servo valve 62 which determines the rotation of the support 25. It is understood that the rotation also can be modified by superimposing several program curves similar to the program curves 63 and 64.

Figure 18:
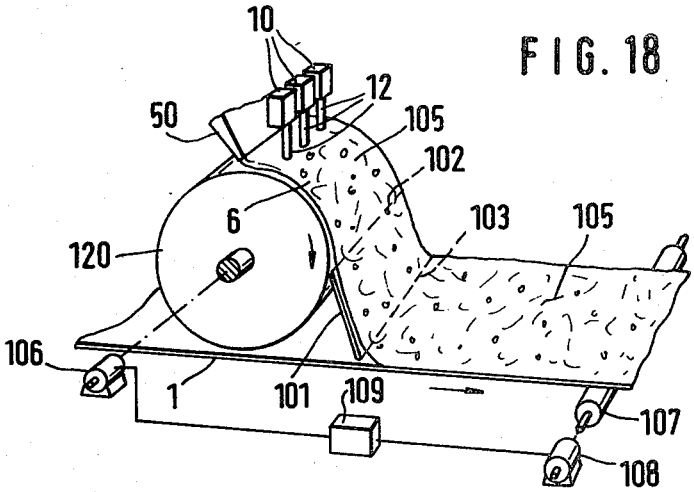
FIG. 18 is a perspective schematic view of a further embodiment of the present invention utilizing a roller.
Figure 19:
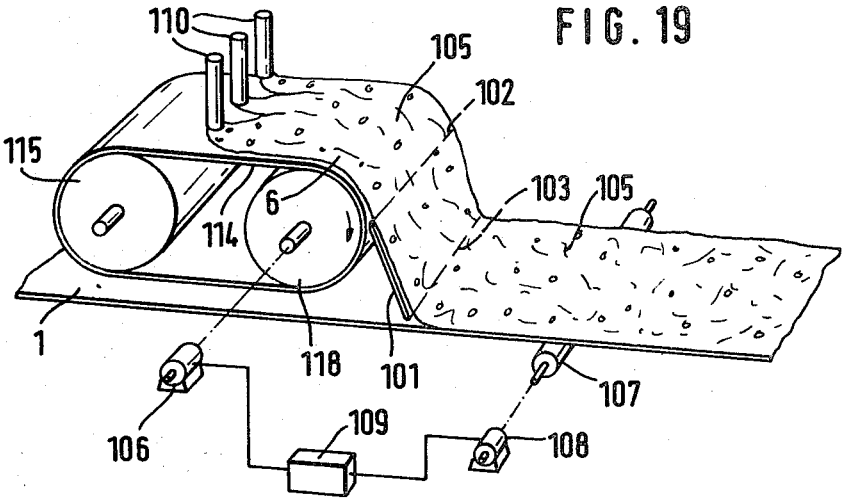
FIG. 19 is a similar view of an embodiment with a rotating belt.

Important embodiments of the present invention are shown in FIGS. 18 and 19. In the embodiment according to FIG. 1, the foam layer 6 slides down over the plate 3 under the action of gravity in the direction of the arrow 7, and then is transferred to the web 1. The velocity of the sliding foam layer is limited. If the pattern formed on the plate 3 is to be transferred to the web 1 without distortion, its forward velocity must correspond to the velocity of the layer 6 which is sliding down over the plate 3. In such a case, this limits the permissible forward velocity of the web 1 and thereby, the operating speed of the pattern generating apparatus. If forward velocity of the web 1 is increased, the patterns formed on the web 1 are stretched, which is undesirable particularly because the web 1 thereby is given a pronounced preferred direction.

In the devices according to FIGS. 2 and 3, the web runs with the same velocity as the belt 14 or the drum 20. Instead, however, an engagement takes place at the foam layer 6, inasmuch as the web 1 runs upon the foam layer 6 from above and locks up the foam layer 6 between the belt 14 or the drum 20 and the web 1, and is urged into the web 1. Thereby, the pattern formed in the foam layer 6 is changed in a manner which at times is desired but is not desirable in other cases.

Also if the web 1 were not resting against the belt 14 or the drum 20 but were to run along the belt 14 or the drum 20 with very little spacing, the pattern would be influenced when the foam layer 6 is transferred to the web 1, inasmuch as the foam layer 6 would be partially torn up. The distinctness of the pattern is lost and practice has shown that only very blurred pattern structures can be generated in this manner.

In the embodiments according to FIGS. 2 and 3, the velocity of the revolving elements 14 and 20, is automatically the same as that of the web 1. This, too, is not always desirable because sometimes, desired interventions into the appearance of the patterns are possible by changing the velocity ratio.

The further problem arises here to transfer a patterned foam layer to a running web while preserving the pattern and without intervention at the foam layer from above, without automatic ties between the velocity of the foam layer and the velocity of the web.

In the embodiment according to FIG. 18, the foam layer 6 is generated as in the embodiment according to FIG. 3 on a revolving drum 120, but without contact between the web 1 on the drum 120. Rather, the web 1 runs, in the manner seen in FIG. 18, underneath the drum 120 with a spacing; the axis of the drum extends transversely to the web of material 1 parallel to and above the web. On the descending side, for rotation in the direction of the arrow, a wiper 101 rests against the drum 120; this wiper has the form of an elongated rectangular slat, the top edge 102 of which touches the drum 120 and strips-off the foam layer formed on the drum 120, which then slides down over the wiper 101 which is inclined downward at an angle with respect to the web 1 and is transferred from the lower edge 103 of the wiper 101, arranged above the web 1, to the web of material 1. The foam layer 6 thus gets onto the web 1 without engagement of the foam layer 6 from above and without ties between the forward velocity of the web 1 and the speed of rotation of the drum 120.

The drum 120 is driven by the motor 106, while the drive for the web 1 is shown schematically by an arrangement where a support roll 107 which advances the web, is driven by the motor 108. The motors 106 and 108 are both controlled by a control device 109 which controls the forward velocity of the web 1 and the speed of rotation of drum 120 in a mutual relationship which can be selected at will.

The manner in which the pattern indicated by the lines 105 is generated in the foam layer 6 is immaterial to the principle of operation of the embodiments shown in FIGS. 18 and 19.

In the embodiment of FIG. 18, a slit nozzle 50 is provided, according to FIGS. 15 and 16, which extends over the width of the web 1 and by means of which a uniform foam layer is generated to which a pattern is then applied at a point following in the direction of rotation of the drum 120, by engagement elements 12 mounted at motion generators 10.

The embodiment of FIG. 19 differs from the embodiment according to FIG. 18 in that the revolving element is not a drum but an endless belt 114 which is conducted over two cylinders 115 and 118 which have mutually parallel axes arranged above the web of material 1 and extending transversely thereto. The lower section of the belt 114 is disposed above the web 1 with spacing. In FIG. 19, also, the removal of the foam layer 6 is accomplished by a wiper 101 which rests against the outside of the belt 14 on the side of the cylinder 18 descending during revolution. The belt is advantageously designed as a steel belt.

The patterned foam layer 6 is generated in this case by several foam applicators 110 which may be movable transversely to the web and independently of each other and deliver foam to the web. The pattern is obtained by causing different foams come to bear at different places of the web, or also seeing that, while one and the same foam emerges from the foam applicators 110, this foam is present with different height at different points of the web. The relief of the foam layers 6 generated in this manner manifests itself in a corresponding pattern on the web 1, for instance, in a pattern of different depths of color.

The pattern application by means of slits nozzles 50 and engaging elements 12 as per FIG. 18, can be applied, of course, also in the embodiment according to FIG. 19 and vice versa.

The embodiments according to FIGS. 18 and 19 permit a higher forward velocity of the web 1 than the embodiment according to FIG. 1 because the drum 120 or the belt accelerate the foam layer 6 and push it down via the wiper 101. Although application velocities arbitrarily high cannot be obtained because of the very limited ability of the foam to transmit pressure, a distinct improvement of the performance over an embodiment such as that in FIG. 1 is observed. A contribution in this direction is added if the wiper 101 is made rather thin.

By means by the control devices 109 and variation of the relative speed of the web and roller, the pattern generated on the web 1 can be stretched lengthwise in a desired manner or shortened in the longitudinal direction.

What is claimed is:

1. Method for applying a pattern to a continuously advancing web with a treatment medium contained in a foam comprising:

(a) applying the foam to an element revolving about an axis extending transversely to the web;

(b) generating a patterned foam layer on the element;

(c) wiping the foam off the revolving element with a wiper blade and transferring it by the wiper blade to the web of material which passes underneath without making contact; and (d) controlling the forward velocity of the web of material and the speed of rotation of the revolving element to obtain a desired pattern effect on the web.

2. The method according to claim 1, comprising applying a uniform foam layer to the revolving element, and patterning the foam layer after application to the revolving element.

3. The method according to claim 1, comprising applying foams to the revolving element from different foam applicators, to form a patterned foam layer on the revolving element.

4. A device for applying patterns to a continuously advancing web with a foam containing treatment medium, comprising:

an endless revolving belt which is conducted over two cylinders revolving above the web about axes extending transversely to the web;

means arranged above the revolving element for generating a patterned foam layer on the revolving element;

a wiper extending transversely over the web, having an upper edge and a lower edge, said upper edge resting against the side of said revolving means descending during rotation for stripping the foam layer from the revolving element, and said lower edge disposed above the web of material and parallel thereto; and means for controlling the forward velocity of the web of material and the speed of rotation of the revolving element in a selectable mutual relationship.

5. A device according to claim 4, further comprising a device for applying a foam layer which is coherent over the width of the web, disposed above said means revolving and, at a point following in the direction of rotation, said means for generating a patterned layer comprising at least one motion generator and a foam engagement element connected thereto.

6. A device according to claim 4, wherein said means for generating a patterned foam layer comprises at least two foam feeding devices arranged to form a patterned foam layer on said means revolving disposed above said means revolving.

7. A device for applying patterns to a continuously advancing web with a foam containing treatment medium, comprising:

means revolving about an axis extending transversely to the web;

means arranged above the revolving element for generating a patterned foam layer on the revolving element including at least two foam feeding devices arranged to form a patterned foam layer on said means revolving, disposed above said means revolving;

a wiper extending transversely over the web, having an upper edge and a lower edge, said upper edge resting against the side of said revolving means descending during rotation for stripping the foam layer from the revolving element, and said lower edge disposed above the web of material and parallel thereto; and means for controlling the forward velocity of the web of material and the speed of rotation of the revolving element in a selectable mutual relationship.

8. A device according to claim 7, wherein said means revolving is a drum which extends above the web and rotates about an axis extending transversely thereto.

9. A device according to claim 7, wherein said means revolving comprises an endless revolving belt which is conducted over two cylinders revolving above the web about axes extending transversely to the web.

* * * * *